United States Patent [19]

Midlik

[11] Patent Number: 4,579,303

[45] Date of Patent: Apr. 1, 1986

[54] GUTTER JACK

[76] Inventor: William M. Midlik, 573 Turtle Creek Cir., Birmingham, Ala. 35226

[21] Appl. No.: 627,344

[22] Filed: Jul. 2, 1984

[51] Int. Cl.[4] ..... E04D 13/06

[52] U.S. Cl. ..... 248/48.2; 52/11; 52/741; 248/222.4

[58] Field of Search ..... 52/11, 12, 13, 14, 15, 52/16, 741, 747, 94–96; 248/48.1, 48.2, 222.4, 222.3, 223.1, 223.2; 269/55, 74, 79, 81, 307; 33/407–410

[56] References Cited

U.S. PATENT DOCUMENTS

| | | | |
|---|---|---|---|
| 1,594,101 | 7/1926 | Knab | 248/48.2 |
| 1,639,916 | 8/1927 | Wilson | 248/48.2 |
| 3,148,453 | 9/1964 | DiCarlo | 33/410 |
| 3,317,167 | 5/1967 | Becker et al. | 248/222.4 |
| 4,411,108 | 10/1983 | Kerester | 248/48.2 X |

FOREIGN PATENT DOCUMENTS

| | | | |
|---|---|---|---|
| 407057 | 11/1970 | Australia | 248/48.2 |
| 47801 | 1/1978 | Japan | 52/11 |
| 777256 | 6/1957 | United Kingdom | 52/11 |

OTHER PUBLICATIONS

Modern Hanger Corp., ©1953, p. 75.

*Primary Examiner*—Donald G. Kelly
*Assistant Examiner*—Richard E. Chilcot, Jr.

[57] ABSTRACT

"Gutter Jack" is a mechanical device which is temporarily attached to the facia board at the end of the roof to support and to adjust the slope of the rain gutter during the installation. A gutter jack is generally used at each end of the rain gutter to be installed or at an intermediate position as required. The gutter jack includes a base mounting plate which is temporarily attached to the facia board and an adjustable Z-Bar bracket which supports the rain gutter and sets the slope. The Z-Bar bracket is easily adjusted and locked in position by loosening and re-tightening wing nuts.

5 Claims, 1 Drawing Figure

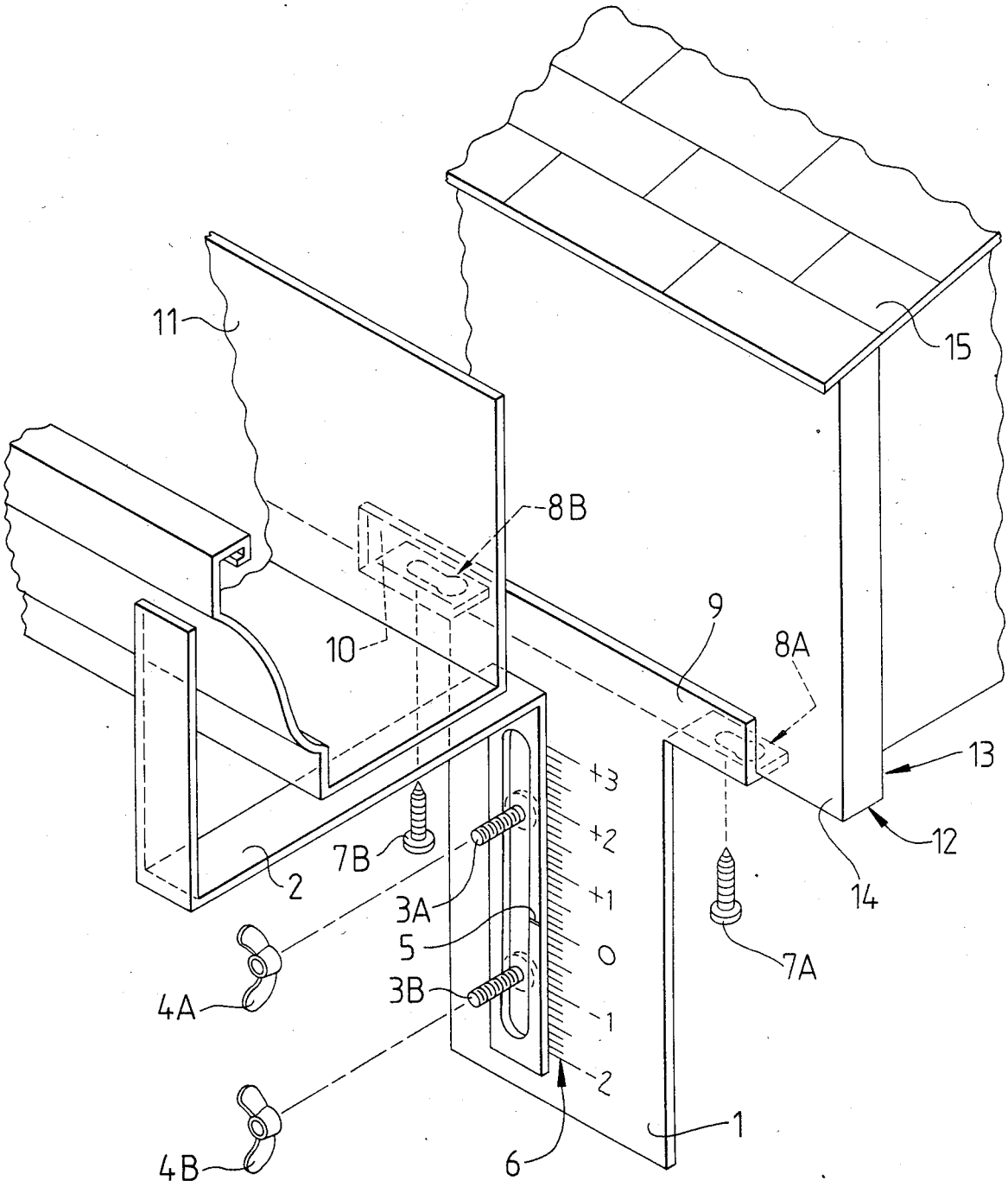
11
15
8B
9
10
8A
13
+3
+2
+1
0
-1
-2
12
7B
2
3A
14
5
7A
4A
3B
4B
6
1

GUTTER JACK

FIELD OF THE INVENTION

This invention relates generally to the field of mechanical devices related to the installation of rain gutters and in particular provides a tool for supporting the rain gutter during installation, which provides a method of adjusting the slope of the rain gutter during installation.

BACKGROUND OF THE INVENTION

As is known to those skilled in the installation of rain gutters, and as is particularly well known to house owners, rain gutters are in many cases installed with no slope, thus permitting water to lay in the rain gutter and thereby causing the gutter to rust in a very short period of time. Also rain gutters are not maintained free of debris and leaves, the accumulation of which holds moisture which will cause rain gutters to eventually rust, thusly, requiring more frequent rain gutter replacement. The problems which exists in rain gutter installation are as follows:

(1) Generally two people are required to install the rain gutters, one person at each end of the gutter supporting the gutter and simultaneously trying to set the slope of the rain gutter.

(2) Each worker has his hands occupied fully by holding on to the ladder, supporting one end of the gutter, simultaneously making measurements, adjusting the gutter into the desired position for installation, and using tools and hardware to install the rain gutter. The problem associated with all of this simultaneous activity is that it becomes unsafe in the installation process.

Accordingly, there exists a need in the rain gutter installation art for a mechanical device, such as gutter jack, to be used in an improved method of rain gutter installation.

SUMMARY OF THE INVENTION

Through the use of my gutter jacks, the above problems are alleviated in that the rain gutter is supported mechanically and a means of setting the slope of the rain gutter is provided by merely adjusting the position of a Z-Bar bracket, in accordance with a reading on a scale provided on the gutter jack. The installation process becomes safer, provides more accurate slope setting of the rain gutter in a shorter period of time, and the installation can be done with only one installer, if required.

Accordingly, it is the object of the present invention to overcome the above noted prior art of rain gutter installation problems and to achieve the above stated need.

The mechanical device, known as gutter jack, which is temporarily attached to the facia board, provides a means of mechanically supporting the rain gutter and provides a means of easily adjusting the desired slope of the rain gutter during the installation process. The gutter jack is designed with easy-on/easy-off method of attachment to the facia board and a quick and accurate method of setting the slope.

DESCRIPTION OF THE DRAWING

The enclosed drawing is a perspective view of a portion of the building provided wth a rain gutter and showing the present invention as used in installing the gutter.

Referring now to the drawing, there is shown a portion of the building roof 15 with a rain gutter 11, being installed with the aid of the present invention. In the manner known to those skilled in the art, the rain gutter 11 is attached to the upper part of facia board 14 of the building by suitable means, not shown, such that the rain gutter is adjacent and below the edge of the roof 15. The present invention consists of two main parts which are the base mounting plate 1 and the Z-Bar bracket 2. The function of the base mounting plate 1 is to support Z-Bar bracket 2, which supports the rain gutter 11, during installation only. The Z-Bar bracket 2 is bolted to the base mounting plate 1 through the use of upper and lower carriage bolts 3A and 3B respectively, and its associated Wing Nuts 4A and 4B. Z-Bar bracket 2 has a slotted hole to allow it to slide up and down to permit adjustment of the height of the Z-Bar bracket 2, thereby setting the slope of the rain gutter 11 which is being installed.

The base mounting plate 1 and Z-Bar bracket 2 are constructed of steel, aluminum, or other suitable material such as high strength plastics. Carriage bolts 3A and 3B, wing nuts 4A and 4B and self-tapping screws 7A and 7B are all standard hardware items. The overall dimension of the T-shaped base mounting plate 1 would be in the range of $7\frac{1}{2}$ inches in height at the top and about 3 inches in width at the bottom and about 0.090 inches thick. The overall dimension of the Z-Bar bracket 2 would be in the range of 1 inch wide, $\frac{1}{8}$ inch thick, and has an unbent length about 18 inches. It is bent to form about a 4 inch vertical section, 6 inch horizontal section and about an 8 inch section with slotted hole, as can be seen in the drawing. The slotted hole is about $\frac{1}{4}$ inch wide by 7 inch long. The length of the slot is designed to allow the adjustable height of the Z-Bar bracket 2 to go from about three inches above and about two inches below the bottom 12 of the facia board 14. The scale 6 as shown in the drawing reflects this range in adjustable height although other ranges may be useful. The reference mark 5, located on Z-Bar bracket 2 is used as the reference mark for reading the scale 6. Reference mark 5 is positioned on the Z-Bar bracket 2 so that at 0" on scale 6 indicates that the top of Z-Bar bracket 2 is at the bottom 12 of the facia board 14.

To begin the installation of the base mounting plate 1, with the tabs having keyhole slots 8A and 8B, is placed at the bottom of facia board 12. The base mounting plate 1 is only temporarily attached to the facia board 14 and re-located as the rain gutter 11 installation continues. There are two methods of temporarily attaching the base mounting plate 1 to the facia board 14. The first method is with the use of vice grip pliers (not shown). The jaws of the vice grip pliers are attached at position 9 or position 10 of the base mounting plate 1. Adjust the vice grip pliers to ensure that enough pressure will be exerted to hold the base mounting plate 1 against the face of the facia board 14.

Another method of attaching the base mounting plate 1 to the facia board 14 is to use two self-tapping screws 7A and 7B on the bottom side 12 of facia board 14. The keyhole slots 8A and 8B are used to facilitate ease of mounting the base mounting plate 1 at the bottom 12 of the facia board 14. The advantage of using vice grip pliers to attach the base mounting plate 1 to the facia board 14 is to utilize the easy on/easy off concept of attachment.

The method of selecting vice grip pliers or self-tapping screws 7A and 7B to secure the base mounting plate 1 to facia board 14 are as follows:

1. Self-tapping screws 7A and 7B can be used anytime but does not have the advantage of easy on/easy off concept of attaching the base mounting plate 1 to facia board 14.
2. Vice grip pliers can only be used when the extended part 13 of facia board 14 exists and when the position of the Z-Bar bracket 2 is from 0" to +3" as read by the reference mark 5 on scale 6 on base mounting plate 1. For position of the Z-Bar bracket from 0" to −2", the rain gutter 11 would interfere with the vise grip pliers, thusly requiring the use of self-tapping screws 7A and 7B. It is probable that the bottom of rain gutter 11 could be lower than the bottom 12 of the facia board 14 for long runs of rain gutter 11.
3. The use of self-tapping screws 7A and 7B must be used for rain gutter installations when the extended part 13 of the facia board 14 does not exist.

The installation process for installing rain gutter 11 begins by installing one each base mounting plate 1 to the facia board 14 for each end of the rain gutter 11. The spacing of distance between the two "gutter jacks" will depend upon the length of rain gutter 11 that is to be installed. For very long continuous length rain gutter 11, it is recommended that a "gutter jack" be placed every ten or twenty feet. Once the rain gutter 11 is placed on top of the Z-Bar bracket 2, the slope of the rain gutter 22 needs to be set. This is accomplished by loosening both wing nuts 4A and 4B to permit movement of the Z-Bar bracket 2 to set the height of the rain gutter 11 at each gutter jack. Once the slope is determined, and the position of Z-Bar bracket 2 is set for the desired slope, the wing nuts 4A and 4B are tightened to lock the vertical position of the Z-Bar bracket 2, which sets the height of each end of the rain gutter 11. This section of rain gutter 11 is now ready to be attached to the upper part of the facia board 14. After installation of the first section of rain gutter 11, the "gutter jacks" which were temporarily attached to the facia board 14 can be removed and relocated for installation of the next section of rain gutter 11, until completion of rain gutter 11 installation.

The embodiments of an invention in which an exclusive property or privilege is claimed are defined as follows:

1. Apparatus for use in installing and adjusting the slope of a rain gutter while installing said rain gutter adjacent a roof facia board comprising:

(a) a detachable mounting plate adapted for temporary affixation to said facia board to facilitate installation of said gutter and having thereon a plurality of graduated, vertically spaced markings forming a scale; and (b) a bracket member slidably affixed to said mounting plate, said bracket member having an indicator thereon and a top portion positioned vertically relative to said facia board in accordance with the position of said indicator relative to said graduated markings, whereby said bracket member may be positioned at a selected height relative to said facia board by slidably moving said bracket to position said indicator adjacent a predetermined graduated marking.

2. Apparatus as defined in claim 1 wherein said bracket member has a vertically oriented slot therein and wherein said bracket member is attached to said plate by a pair of threaded connectors extending through said plate and said slot and adapted to urge said bracket member against said plate in non-sliding engagement.

3. Apparatus as defined in claim 2 wherein each of said threaded connectors comprises:

(a) an elongated threaded member extending from said plate through said slot; and (b) a nut threadedly engaging said threaded member and adapted for manual tightening thereon.

4. Apparatus as defined in claim 1 wherein said bracket member comprises:

(a) a lower vertical section adapted for sliding engagement with said plate to selected positions relative thereto and having said indicator affixed thereto;

(b) a substantially horizontal section extending from an upper portion of said lower vertical section outwardly from said plate and facia board and spaced in fixed relation to said indicator; and (c) an upper vertical section extending upwards from an outermost portion of said horizontal section.

5. A method of installing a length of rain gutter adjacent a roof facia board whereby the slope of said gutter is adjusted during installation, comprising the steps of:

(a) temporarily affixing a mounting plate to said facia board at each end of said length of rain gutter, with said mounting plate having a graduated scale thereon;

(b) slidably affixing a support bracket to each of said mounting plates such that said brackets may be selectively positioned at various heights corresponding to positions on said graduated scale;

(c) placing said rain gutter on said bracket adjacent said facia board;

(d) adjusting the position of each support bracket to a selected position on said graduated scale to achieve a predetermined slope of said rain gutter;

(e) affixing said rain gutter to said facia board; and (f) removing said mounting plate and support bracket from said facia board.

* * * * *